United States Patent [19]

Liddle

[11] Patent Number: 4,493,665

[45] Date of Patent: Jan. 15, 1985

[54] HYDROFOIL

[76] Inventor: Edward M. Liddle, 9784 Rim Park Way, San Diego, Calif. 92124

[21] Appl. No.: 385,303

[22] Filed: Jun. 7, 1982

[51] Int. Cl.[3] ..... A63C 15/05

[52] U.S. Cl. ..... 441/79; 114/127; 114/140

[58] Field of Search ..... 114/39, 127-143, 114/274, 279; 441/74, 79

[56] References Cited

U.S. PATENT DOCUMENTS

| | | | |
|---|---|---|---|
| 2,068,921 | 1/1937 | Leigh | 114/140 |
| 3,308,493 | 3/1967 | Lambach | 441/79 |
| 3,585,663 | 6/1971 | Johnson | 441/79 |
| 3,802,374 | 4/1974 | Brown | 441/74 |
| 4,253,209 | 3/1981 | Carn | 114/39 |
| 4,320,546 | 3/1982 | Knox | 441/79 |
| 4,377,124 | 3/1983 | Guigan | 114/143 |

FOREIGN PATENT DOCUMENTS

| | | | |
|---|---|---|---|
| 34990 | 9/1981 | European Pat. Off. | 441/79 |

*Primary Examiner*—Sherman D. Basinger
*Assistant Examiner*—Stephen P. Avila
*Attorney, Agent, or Firm*—Thomas J. Tighe

[57] ABSTRACT

A fin which can be secured in the channel of a curved fin box in a plurality of locations. The fin has a grooved flange which mates with the open channel of the fin box. One wall of the channel has a groove which aligns with the flange groove and a fastening rod is inserted therein. The fin is prevented from longitudinal movement within the channel by a tab and tab receiving. A pair of the curved fin boxes and fin are affixed to a surfboard as thruster fins. The manuverability of the surfboard is enhanced and can be varied by the repositioning of the thruster fins within the curved fin boxes. At one extreme the line of the fins is parallel to the center line of the surfboard, and at the other extreme the thruster fins are toed-in and form equally but oppositely directed angles with respect to the center line.

13 Claims, 9 Drawing Figures

HYDROFOIL

BACKGROUND OF THE INVENTION

This invention relates to hydrofoils and hydrofoil mounting means in general, and in particular, to hydrofoils which can be repositioned.

It is well known that hydrofoils, such as fins which are attached to surfboards and other hulled craft, can be used to provide a desired reaction force when in motion relative to the fluid through which the hydrofoil is passing. As used hereinafter, the term "surfboard" shall include surfboards, boogie boards, wind surfing boards, and other hulled craft, which are manuevered by shifting the weight borne by the craft relative to the craft's center of gravity.

Hydrofoils are commonly used for directional stability but they have also been used to enhance manueverability of surfboards. It has become common practice to put a plurality of fins on the underside of surfboards. A fin located along the center line of the board generally is used to provide directional stability, but a pair of fins, commonly called "thruster fins", are generally spaced apart equally from the center line and are used to enhance turning response, that is, to increase maneuverability.

When first put into use, the edges of the thruster fins were generally aligned with the center line of the board. Soon after the introduction of the thruster fins, it was found that if the fins were toed-in, that is, the lines of the fins were not parallel but rather intersected at some point forward of the center of gravity of the board, turning response was enhanced. The current state of the art is such that most surfboards with thruster fins have the fins toed-in, but there is great disagreement with respect to the angle which the lines of the fins should make with respect to the center line of the board. Heretofore, a purchaser of a surfboard would have to, more or less, guess at which toe-in angle was proper or else purchase multiple boards. This invention alleviates that problem. A surfboard utilizing the unique and novel features of this invention allows the purchaser of the board to adjust the angle of the thruster fins to suit his or her weight, level of skill, and other factors.

Another problem associated with fins on surfboards involves the breakage of the fins from the boards. Heretofore, if the board struck an object with enough force to separate the fins from the board, both the board and the fins were severely damaged, and quite often, the damage was irreparable. This invention presents a fin which is designed to break-away with little or no damage when struck by a force severe enough to cause damage to conventional surfboards.

Other advantages and attributes to this invention will be discussed hereinafter and will be obvious upon reading of this specification.

SUMMARY

This invention presents a fin means comprised of a hydrofoil body and, extending from the base of the hydrofoil body and in angular relationship to the body, a fin flange. A groove is defined along one side of the fin flange. A curved fin box, affixed to the bottom of the surfboard, with an open channel adapted to receive the fin flange is also presented. The fin box channel length is suitably greater than the length of the flange in order to permit repositioning of the fin means in a plurality of positions within the channel. Along one side of the channel is defined a longitudinal groove which aligns with the fin flange groove so as to create a closed fastener channel. A flexible fastening rod is inserted within the fastener channel in order to hold the fin flange within the fin box channel. The desired position of the fin means relative to the fin box channel is fixed by a tab means extending from the hydrofoil body downward into one of a plurality of holes defined by the fin box and disposed along a side of the fin box channel.

An object of this invention is to provide hydrofoils for surfboards in the nature of thruster fins which can be suitably repositioned in order to vary the angle of the hydrofoils with respect to the center line of the surfboard.

It is a further object of this invention to provide fin means which can be broken away from the surfboard without causing damage to either the surfboard or the fin means.

It is a further object of this invention to provide thruster fins for surfboards with variable toe-in angles selectable by the user while in the water.

Other objects of this invention will become apparent upon a reading of the text hereinafter.

A BRIEF DESCRIPTION OF THE DRAWINGS

DESCRIPTION OF THE PREFERRED EMBODIMENT

Figure 1:
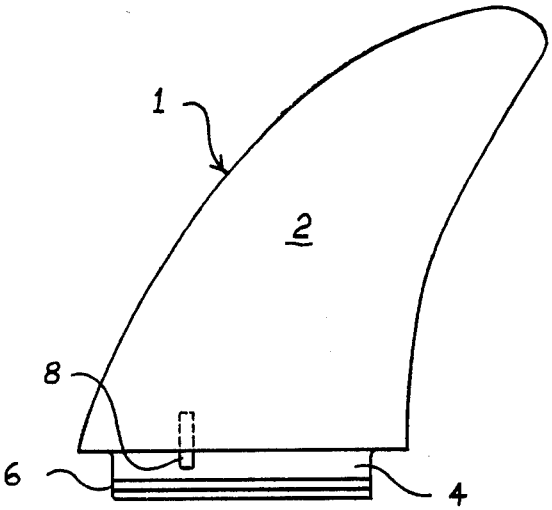
FIG. 1 is a side-view of the fin means.
Figure 2:
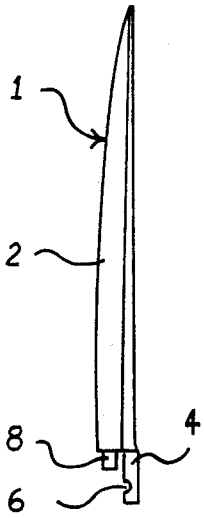
FIG. 2 is an edge-view of the fin means.

Referring to FIG. 1 and FIG. 2, the fin means generally designated 1 is shown. The fin means 1 has a hydrofoil body 2 generally in the shape of a fin. Extending from the base of the hydrofoil body 2 and affixed thereto is a fin flange 4. As will be seen, the fin flange 4 and the body 2 can be in angular relationship to each other. Extending along one side of the fin flange and defined thereby, is a groove 6. Extending downward from the hydrofoil body 2 is a tab means 8.

Figure 3:
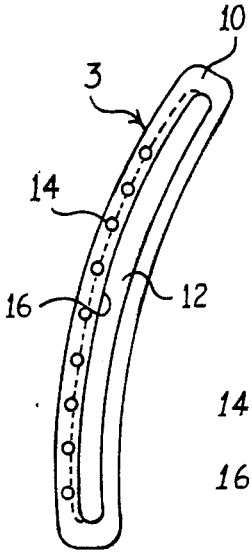
FIG. 3 is a top-view of the fin box.
Figure 4:
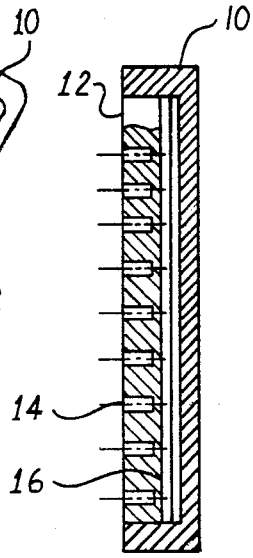
FIG. 4 is a partial cross-section of the fin box.

Referring to FIGS. 3 and 4, a fin box generally designated 3 is shown. The fin box is curved, laterally preferably with a radius of about 7 inches. The fin box 3 has a body in which defines an open channel 12. The open channel 12 is adapted to receive the fin flange 4. Disposed along one side of the fin box channel 12 and evenly spaced apart are a plurality of tab receiving holes 14. The tab receiving holes 14 mate with the tab means 8 in order to longitudinally fix the position of the fin means 1 with respect to the fin box 3. Along one side of the fin box channel 12 is defined a fin box groove 16. As mentioned before, the fin box length is much greater than the fin flange length in order to allow some freedom of positioning of the fin means within the fin box.

Figure 5:
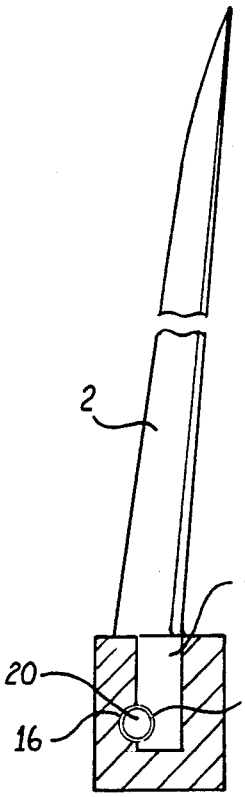
FIG. 5 is a partial section of the fin means attached to the fin box by means of the fastening rods.
Figure 6:
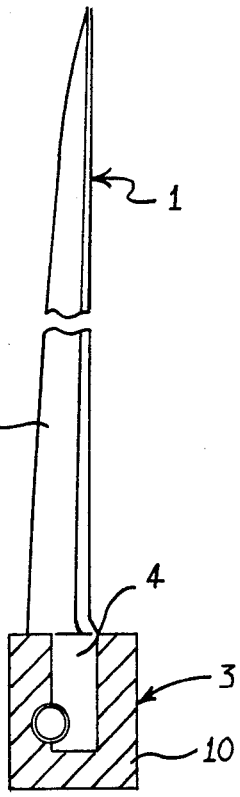
FIG. 6 is the same as FIG. 5 but showing a different angle of the fin means edge with respect to the fin flange.

Referring to FIGS. 5 and 6, a fin means 1 is shown connected to a fin box 3. FIG. 5 shows one example of an angular relationship between the hydrofoil body 2 and the fin flange 4 and FIG. 6 shows a different angular relationship. Thus, it can be seen that the angle of the hydrofoil body with respect to the fin box can be varied at the time the fin means is manufactured by varying the angular relationship between the body and the flange.

Referring again to FIGS. 5 and 6, it can be seen that the fin flange groove 6 and the fin box groove 16 are disposed such that they align when the flange is inserted into the fin box thus forming a closed channel, preferably of circular cross-section. Disposed within the channel to prevent vertical movement of the fin means with respect to the fin box is a flexible fastening rod 20. Preferably the fastening rod 20 can be inserted and removed at will by the user of the surfboard.

Figure 7:
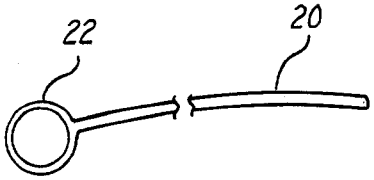
FIG. 7 is a plane view of the fastening rod.

Referring to FIG. 7, a fastening rod 20 is shown with a pull ring 22. The pull ring 22 is used to enable the surfboard user to freely insert and remove the fastening rod 20, even while in the water.

Figure 8:
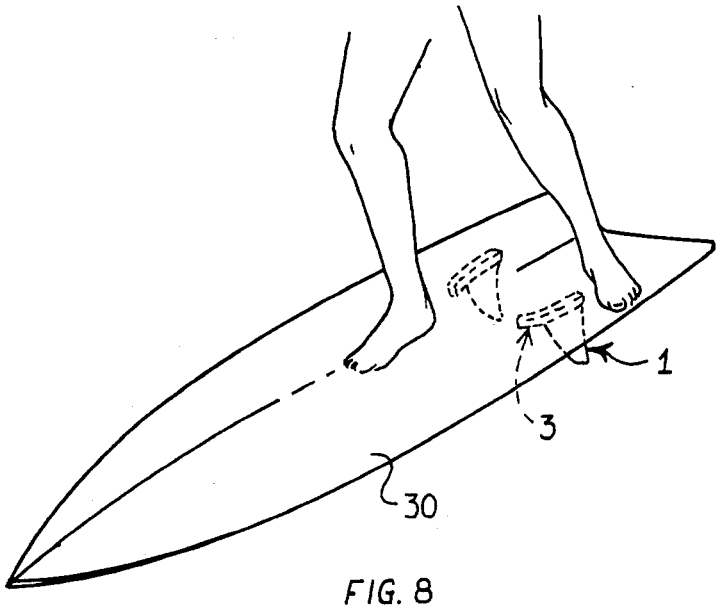
FIG. 8 is a pictorial representation of the fin means and fix box affixed to the surfboard.

Referring to FIG. 8, a surfboard 30 with a pair of symmetrical fin boxes 3 and a pair of symmetrical fin means 1 attached thereto are shown. As can be seen from the drawings, the fin boxes are symmetrically affixed to the surfboard on opposite sides of the surfboard longitudinal centerline, centerline being synonymous with the keel-line.

Figure 9:
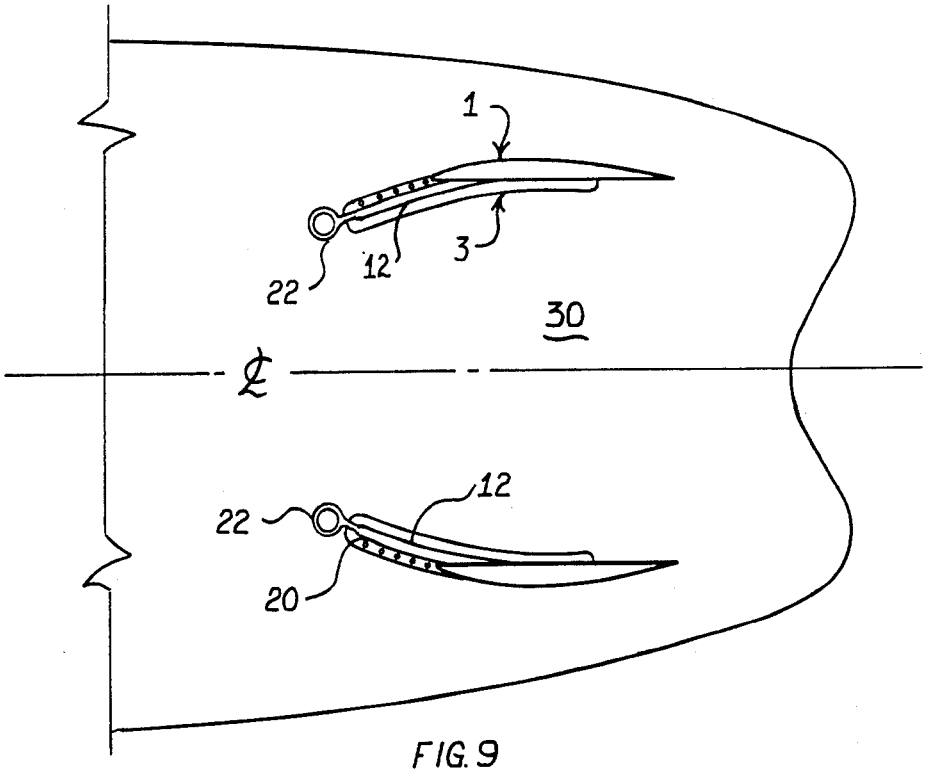
FIG. 9 is a partial bottom view of a surfboard showing the fin means located in the farthest backward position with respect to the fin box.

Referring to FIG. 9, the underside of the board in FIG. 8 is shown. As can be seen, a pair of fin boxes 3 are spaced apart equidistant from the center line of the surfboard 30. The fin boxes 3 are affixed to the surfboard by routing out from the board a curved slot to match the profile of a box and adhesively dropping the box into the curved slot. The pull rings 22 of the two fastening rods 20 can be seen protruding from the open channel 12.

The fastening rod can be made of a variety of material such as rubber, metal and plastic, e.g. nylon. The operable characteristics of the rod are that the rod is stiff and resilient in that it is highly resistant to compression forces along its longitudinal axis but it strongly tends to return to an unbent configuration when the rod is bent in an arc.

As stated before, the open channel is longer than the length of the flange therefore no matter what position is selected for the fin means, there will be a gap between one or both ends of the channel and one or both vertical ends of the flange. The fastening rod is inserted by directing it down into the open channel through a gap and into the closed channel. Once inserted, the rod is held in place by friction because the rod remains bent since a portion of the rod extends beyond both of the closed and open channels. The fastening rod is extracted by simply pulling the pull ring.

An alternate embodiment of this invention presents a fastening rod which is suitably compressable by forces applied generally transverse to its longitudinal axis. The purpose of the transversal compressability is to permit the fin means to break away from the fin box when it is forcefully jarred. In addition to the compressability of the fastening rod, it is preferable to suitably reduce in dimension the thickness of the horizontal edge of the flange below the flange groove. The combination of the reduced flange thickness below the groove and the transversal compressability of the fastening rod will allow the fin flange to slip by the fastening rod when the fin is jarred to the point where damage might occur to the fin and/or the surfboard. In this configuration, the tab means is preferably bendable but yet resilient under the same force conditions.

As previously mentioned, the advantages of having the thruster fins toed-in is the enhanced maneuverability. When the fins are pointed more towards the center line, the board is more responsive to the shifting weight and therefore will turn more quickly. When the fins are more closely parallel to the center line, the board is less responsive during turns but has more directional stability and less resistance to forward movement. Thus it can be seen that it is advantageous to be able to vary the angle which the fins make with respect to the center line on an individual user basis.

The foregoing description was given for illustrative purposes only and no unnecessary limitations in the claims which follow should be construed therefrom.

I claim:

1. A hydrofoil comprising:

(a) a fin means, (b) an elongated fin flange affixed to a base of the fin means, (c) a fin box means defining an elongated, laterally curved open channel" adapted to receive the fin flange at a plurality of locations along the length of the open channel, the fin box being affixed to a hull, (d) a longitudinal groove defined by the fin flange, (e) a longitudinal groove defined by a wall of the open channel and adapted to align with the fin flange groove when the fin flange is disposed in the open channel such that the two grooves in alignment form a generally closed channel, (f) a fastening rod adapted to be inserted into the closed channel for the purpose of holding the two grooves in alignment and thereby inhibiting transversal movement of the fin flange with respect to the fin box, and (g) means to inhibit longitudinal movement of the fin flange with respect to the fin box.

2. The hydrofoil of claim 1 wherein the fastening rod is resiliently bendable and is adapted to have a free end of the rod bent outward from the open channel and protrude therefrom when the rod is disposed in the closed channel, and further comprising a gripping means affixed to the free end of the rod for manually inserting and exserting the fastening rod.

3. The hydrofoil of claim 2 wherein the gripping means is adapted to hold the fastening rod in a bent position such that the resiliency of the rod presses the gripping means against the fin box means to frictionally hold the rod in place.

4. The hydrofoil of claim 3 wherein the means to inhibit longitudinal movement of the fin flange with respect to the fin box is a tab means affixed to the fin means and protruding therefrom and a plurality of tab receiving apertures defined by one wall of the open channel, the tab receiving apertures each being adapted to engage the tab means.

5. The hydrofoil of claim 2, 3 or 4 wherein the fastening rod is suitably compressable to forces applied transversal to the rod's longitudinal access to permit the fin means to be broken away from the fin box without damaging either.

6. The hydrofoil of claim 5 wherein in the fin flange is reduced in thickness below the fin flange groove to enhance the ability of the fin means to break away from the fin box without damage.

7. In a surfboard hydrofoil the improvement comprising:

(a) a pair of symmetrical fin means, (b) a pair of symmetrical fin boxes symmetrically affixed to the surfboard on opposite sides of a surfboard longitudinal centerline, (c) each fin box defining an elongated, open channel, each open channel being laterally and symmetrically curved toward the centerline, each open channel being adapted to receive a portion of fin means at a plurality of locations along the length of the open channel such that at one extreme location a plane of the fin means is substantially parallel to the centerline and as the fin means is relocated along the open channel toward an opposite extreme location the plane of the fin means is at an increasingly divergent angle with respect to the centerline, and (d) means for releasably securing each fin means to its respective fin box.

8. The improvement of claim 7 wherein the means for releasably securing each fin means to its respective fin box comprises:

(a) an elongated fin flange means affixed to the base of the fin means, (b) a longitudinal groove defined by the fin flange, (c) a longitudinal groove defined by a wall of the open channel and adapted to align with the fin flange groove when the fin flange is disposed in the open channel such that the two (2) grooves in alignment form a generally closed channel, (d) a fastening rod adapted to be inserted into the closed channel for the purpose of holding the two (2) grooves in alignment and thereby inhibiting transversal movement of the fin flange with respect to the fin box, and (e) means to inhibit longitudinal movement of the fin flange with respect to the fin box.

9. The improvement of claim 8 wherein the fastening rod is resiliently bendable and is adapted to have a free end of the rod bent outward from the open channel and protrude therefrom when the rod is disposed in the closed channel and further comprising a gripping means affixed to the free end of the rod for manually inserting and exserting the fastening rod.

10. The improvement of claim 9 wherein the gripping means is adapted to hold the fastening rod in a bent position such that the resiliency of the rod presses the gripping means against the fin box means to frictionally hold the rod in place.

11. The improvement of claim 10 wherein the means to inhibit longitudinal movement of the fin flange with respect to the fin box is a tab means affixed to the fin means and protruding therefrom and a plurality of tab receiving apertures defined by one wall of the open channel, the tab receiving apertures being adapted to engage the tab means.

12. The improvement of claim 9, 10 or 11 wherein the fastening rod is suitably compressable to forces applied transversal to the rod's longitudinal axis to permit the fin means to be broken away from the fin box without damaging either.

13. The improvement of claim 12 wherein the fin flange is reduced in thickness below the fin flange groove to enhance the ability of the fin means to break away from the fin box without damage.

* * * * *